US006010412A

United States Patent [19]

Moriyama

[11] Patent Number: 6,010,412

[45] Date of Patent: Jan. 4, 2000

[54] MULTI-PIECE SOLID GOLF BALL

[75] Inventor: Keiji Moriyama, Shirakawa, Japan

[73] Assignee: Sumitomo Rubber Industries, Ltd., Hyogo-ken, Japan

[21] Appl. No.: 08/965,095

[22] Filed: Nov. 6, 1997

[30] Foreign Application Priority Data

Nov. 6, 1996 [JP] Japan ..... 8-293680

[51] Int. Cl.[7] ..... A63B 37/06

[52] U.S. Cl. ..... 473/373; 473/374

[58] Field of Search ..... 473/372, 373, 473/374, 375, 376, 369

[56] References Cited

U.S. PATENT DOCUMENTS

| | | | |
|---|---|---|---|
| 4,085,937 | 4/1978 | Schenk . | |
| 4,714,253 | 12/1987 | Nakahara et al. . | |
| 4,863,167 | 9/1989 | Matsuki et al. . | |
| 5,002,281 | 3/1991 | Nakahara et al. . | |
| 5,482,285 | 1/1996 | Yabuki et al. | 473/374 X |
| 5,688,192 | 11/1997 | Aoyama | 473/369 X |
| 5,733,205 | 3/1998 | Higuchi et al. | 473/373 X |
| 5,799,562 | 7/1998 | Melvin et al. | 473/376 X |

FOREIGN PATENT DOCUMENTS

| | | |
|---|---|---|
| 0600721A1 | 6/1994 | European Pat. Off. . |
| 638913 | 6/1950 | United Kingdom . |
| 2167309 | 5/1986 | United Kingdom . |
| 2306118 | 4/1997 | United Kingdom . |
| 96/40380 | 12/1996 | WIPO . |

*Primary Examiner*—George J. Marlo

[57] ABSTRACT

The present invention provides a multi-piece solid golf ball having high moment of inertia and excellent aerodynamic characteristics whereby long flight distance is obtained. The golf ball of the present invention comprises a core, an intermediate layer of one or more layers formed on the core and a cover for covering the intermediate layer, wherein the core is composed of a molded article containing voids and has a specific gravity of 0.2 to 0.9 and the intermediate layer contains a high-specific gravity filler as a filler and has a specific gravity of 1.1 to 1.8.

4 Claims, 1 Drawing Sheet

MULTI-PIECE SOLID GOLF BALL

FIELD OF THE INVENTION

The present invention relates to a golf ball, more particularly to a multi-piece solid golf ball having large moment of inertia and excellent aerodynamic characteristics whereby longer flight distance is attained.

BACKGROUND OF THE INVENTION

Golf balls which have been known to the art generally include one-piece golf balls, two-piece golfs ball and multi-piece golf balls (e.g. three-piece golf balls, four-piece golf balls, etc.). Intensive study has been made for enhancing the flight performance of the golf ball and increasing flight distance.

The multi-piece golf ball can be one having an intermediate layer between a core and a cover, which has been proposed in Japanese Patent Kokoku Publication Nos. 63 (1988)-61029 and 3 (1991)-3501 and Japanese Patent Kokai Publication No. 2 (1990)-228978. In the proposed three piece solid golf balls, the specific gravity of the intermediate layer is made higher then that of the core so as to increase the moment of inertia of the golf ball. In other words, when the golf ball is hit by a golf club, spin is put on the golf ball and a dynamic lift is exerted in the line normal to the flight curve of the golf ball. However, since a force negative to the ball running direction is exerted on the ascending of the golf ball immediately after launching in the horizontal direction partial force of the dynamic lift, large ball speed immediately after launching is reduced by the dynamic lift. To the contrary, since the dynamic lift due in spin is exerted to the running direction as a positive force in the horizontal direction partial force on descending after the golf ball has already passed the peak position, the dynamic lift on the descending of the golf ball is preferably large so as to increase the flight distance. Accordingly, in order to increase the flight distance of the golf ball, the spin amount on ascending of the golf ball immediately after launching is preferably small and the spin amount on descending of the golf ball is preferably large. In order to increase the flight distance, the larger the moment of inertia of the golf ball, the better. However, when the core of golf balls is formed from a rubber composition, there is a limitation for increasing the moment of inertia, because the rubber itself has a relatively heavy weight.

Japanese Patent Kokai Publication No. 6 (1994)-170012 suggests to lighten the core, wherein the core is composed of a molded article of vulcanized rubber containing a light-weight filler, a resin molded article containing a light-weight filler, or a molded foamed article of rubber or resin. However, this suggestion has a drawback that, since a large amount of the filler is contained in the intermediate layer, the rebound characteristics of the golf ball is low and the flight distance is reduced.

SUMMARY OF THE INVENTION

An object of the present invention is to solve the above problems of a conventional golf ball and to provide a golf ball having a particularly large moment of inertia and excellent aerodynamic characteristics, wherein an increase in flight distance has been attained.

The present inventors have intensively studied to accomplish the above object. As a result, the present inventors have found that, in a multi-piece solid golf ball comprising a core, an intermediate layer of at least one layer formed on the core and a cover for covering the intermediate layer, by using a bubble-containing molded article having a smaller specific gravity as the core and using a high-specific gravity filler having a larger specific gravity as the intermediate layer, a golf ball having a large moment of inertia and excellent flight characteristics can be obtained. Thus, the present invention has been completed.

The present invention provides a multi-piece solid golf ball which comprises a core (1), an intermediate layer (2) of one or more layers formed on the core (1) and a cover (3) formed on the intermediate layer (2), wherein the core (1) is composed of a molded article containing voids and has a specific gravity of 0.2 to 0.9 and the intermediate layer (2) contains high-specific gravity filler and has a specific gravity of 1.1 to 1.8.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
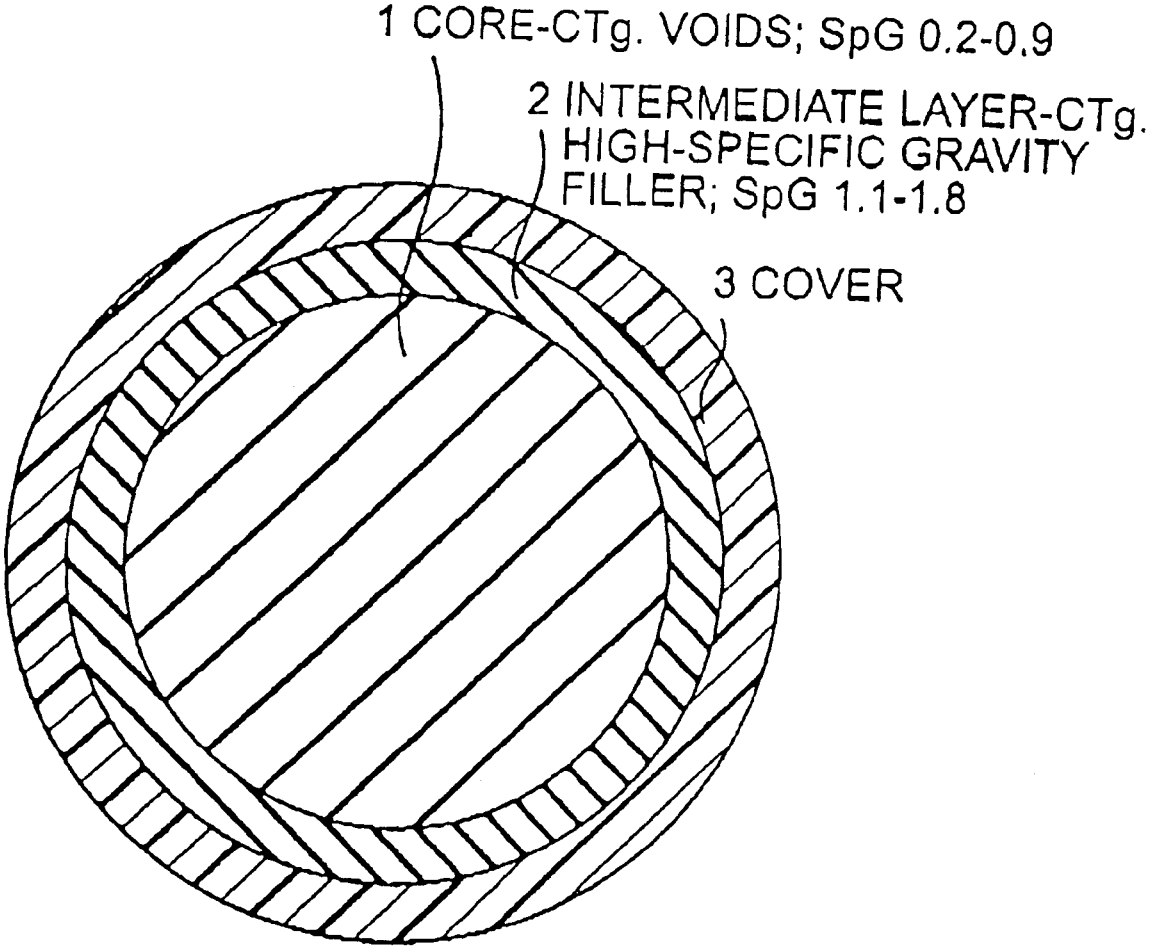
FIG. 1 is a schematic sectional view illustrating the golf ball of the present invention.

The multi-piece solid golf ball of the present invention will be described with reference to FIG. 1. FIG. 1 is a schematic sectional view illustrating the multi-piece solid golf ball of the present invention. In the multi-piece solid golf ball of the present invention, an intermediate layer (2) is formed on a core (1) and a cover (3) is formed on the intermediate layer (2). In the present invention, the core (1) is composed of a molded article containing voids. In the present invention, the intermediate layer (2) may form one or more layers, and at least one layer thereof may contain a high-specific gravity filler as a filler. The layer other than the specific layer may be formed from a material which has been generally used for golf balls. For example, it may be a vulcanized rubber used in the core described hereinafter, or a thermoplastic resin (e.g. ionomer resin, thermoplastic elastomer, etc.). For simplicity of explanation, only a golf ball having one intermediate layer (2) will be described in detail.

The core (1) is roughly divided into two kinds in the present invention. One is a foamed vulcanized molded article of a rubber composition or a foamed molded article of a thermoplastic resin. The other is a vulcanized molded article of a rubber composition containing light-weight filler with voids or a molded article of a thermoplastic resin containing light-weight filler with voids. In case of the rubber molded article, it is obtained by heat-compression vulcanizing a rubber composition containing a foaming agent and a light-weight filler using the method and conditions which are conventionally used for solid cores. In case of the resin molded article, it is formed by molding a resin containing a foaming agent and a light-weight filler using a conventional molding method.

The rubber composition of the vulcanized molded article contains a base rubber, a crosslinking agent, a metal salt of an unsaturated carboxylic acid and, if necessary, an antioxidant. As the base rubber of the rubber composition, for example, natural rubber and/or synthetic rubber, which have hitherto been used in the solid golf ball, are used. Particularly, a so-called high-cis polybutadiene rubber having at least 40%, preferably 80%, of a cis-1,4-bond is preferable. If necessary, natural rubber, polyisoprene rubber, styrene-polybutadiene rubber, ethylene-propylenediene rubber (EPDM), etc. may also be added to the polybutadiene rubber.

Examples of the crosslinking agent include organic peroxides such as dicumyl peroxide, t-butyl peroxide, etc.

Among them, dicumyl peroxide is preferable. An amount of the crosslinking agent is preferably from 0.5 to 3.0 parts by weight based on 100 parts by weight of the base rubber. When the amount is less than 0.5 parts by weight, the resulting golf ball is too soft and, therefore, rebound characteristics are poor and flight distance is lowered. On the other hand, when it exceeds 3.0 parts by weight, the resulting golf ball is too hard and, therefore, shot feel is poor.

The metal salt of unsaturated carboxylic acid acts as a co-crosslinking agent, and examples thereof include monovalent or divalent metal salt of α,β-unsaturated carboxylic acid having 3 to 8 carbon atoms. Monovalent or divalent metal includes sodium, potassium, lithium, zinc, magnesium and the like. Examples of the α,β-unsaturated carboxylic acid having 3 to 8 carbon atoms are acrylic acid or methacrylic acid. Among them, zinc acrylate, which imparts high rebound characteristics, is preferable. In the preparation of the rubber composition, the α,β-unsaturated carboxylic acid may be reacted with a metal oxide such as zinc oxide to form a metal salt of α,β-unsaturated carboxylic acid on kneading. An amount of the co-crosslinking agent is preferably from 15 to 35 parts by weight based on 100 parts by weight of the base rubber. When the amount is lager than 35 parts by weight, the resulting golf ball is too hard and, therefore, shot feel is poor. On the other hand, when it is smaller than 15 parts by weight, the resulting golf ball is too soft and, therefore, rebound characteristics are poor and flight distance is lowered.

The above components are mixed to obtain a rubber composition, which is then vulcanized with heating to obtain a rubber vulcanized molded article. In case of the present invention, the rubber composition is vulcanized with heating after blending the foaming agent or light-weight filler containing voids. The amount of the foaming agent and light-weight filler is not specifically limited, but is from 2 to 25 parts by weight based on 100 parts by weight of the base rubber.

Specific examples of the resin used in the resin foam molded article are thermoplastic resins, preferably ionomer resin, thermoplastic elastomer resin, etc. The ionomer resin can be one prepared by neutralizing a portion of carboxylic acid in an ethylene-(meth)acrylic acid copolymer with metal ion, or a mixture thereof. Examples of the metal ion used for neutralization are alkali metal ion such as Na ion, K ion, Li ion, etc.; divalent ion such as Zn ion, Ca ion, Mg ion, etc.; trivalent ion such as Al ion, Nd ion, etc.; and a mixture thereof. Among them, Na ion, Zn ion, Li ion, etc, are often used in view of the rebound characteristics, durability, etc. Typical examples of the ionomer resins are Hi-milan 1557, 1605, 1705, 1706, 1707, 1855 and 1856 (available from Mitsui Du Pont Polychemical Co.); and IOTEC 7010 and 8000 (available from Exxon Co), but are not limited thereto. The thermoplastic elastomer is a polymer having comparatively high molecular weight, which has urethane bonds as a backbone chain, derived from an aromatic diisocyanate and a polyol of a polyester structure or a polyol of a polyether structure. Specific examples of the polyurethane thermoplastic elastomer include PANDEX T-7890N and T-2983N (available from Dainippon Ink Chemical Industries Co., Ltd.). It is molded under conventional conditions after blending the following foaming agent or light-weight filler containing voids with the above resin. The amount of the foaming agent or light-weight filler is from 2 to 25 parts by weight based on 100 parts by weight of the resin.

As the foaming agent for obtaining a foam molded article, organic foaming agents represented by azodicarbonamide (ADCA), dinitrosopentamethylenetetarmine (DPT), p,p'-oxybisbenzenesulfonyl hydrazide (OBSH), etc. as a chemical foaming agent are preferable, and may be used in combination thereof. Typical examples of the foaming agent are trade name "Vinyhole AC#3" (ADCA), "Cellpaste 101" (DPT), "Cellular GX" (DPT) and the like.

The light-weight filler containing voids includes balloon spherical material, particularly microballon sphere having a particle diameter of 10 to 170 μm, e.g. trade name "Scotchlight Glassbubbles S60/10000" available from Sumitomo Chemical Industries Co., Ltd.

There may be appropriately blended antioxidants or peptizers and other components, which can be normally used in the production of the core of the solid golf ball, with the core of the golf ball of the present invention. The amount of the antioxidant is preferably from 0.2 to 0.5 parts by weight.

The specific gravity of the core (1) is from 0.2 to 0.9 or preferably from 0.4 to 0.7. When it is smaller than 0.2, the ball rebound is too low. On the other hand, when it is larger than 0.9, the moment of inertia is low and the flight distance is the same level as that of the golf ball of the prior art.

The intermediate layer (2) is composed of the same rubber composition as that of the core (1) or a thermoplastic elastomer, and may be formed into two or more layers. It is preferable that the intermediate layer contains a high-specific gravity filler having a specific gravity of 8 to 20, which is selected from the group consisting of metal powder, metal oxide, metal nitride or a mixture thereof, e.g. tungsten powder (specific gravity: 19.3), tungsten carbide (specific gravity: 15.8), molybdenum powder (specific gravity: 10.2), lead powder (specific gravity: 11.3), lead oxide (specific gravity: 9.3), nickel powder (specific gravity: 8.9) and copper powder (specific gravity: 8.9) or a mixture thereof. The fillers must be used to increase the specific gravity of the intermediate layer, and to increase the rebound performance of the rubber/resin component by reducing the amount of the filler as possible. The specific gravity of the intermediate layer (2) is from 1.1 to 1.8, preferably from 1.1 to 1.5. When the specific gravity is smaller than 1.1, the golf ball is too light and flight distance is lowered. On the other hand, when it is larger than 1.8, rebound characteristics are high.

The intermediate layer of the present invention can be produced by using an art-known method which has been used in the formation of the cover of the golf ball, and is not specifically limited. There may be used a method of previously molding a composition for intermediate layer into a semispherical half-shell, covering a core with two of the half-shells, followed by pressure molding, or a method of directly injection-molding the composition for intermediate layer on a core to cover the core. The thickness of the intermediate layer is from 1.0 to 4.0 mm, preferably from 1.6 to 2.3 mm. When the thickness of smaller than 1.0 mm, shot feel when hitting is poor. On the other hand, when it is larger than 4.0 mm, the cover is too soft and, therefore, rebound characteristics are low and flight performance is deteriorated.

The cover is composed of the above described ionomer resin, which has been conventionally used as a cover material of a solid golf ball, but may optionally contains fillers (e.g. barium sulfate, etc.), colorants (e.g. titanium dioxide, etc.) and other additives such as dispersants, antioxidants, ultraviolet absorbers, photostabilizers and fluorescent materials or fluorescent brighteners unless the desired characteristics of the golf ball are adversely affected. The amount of the colorant is preferably from 0.1 to 0.5 parts by weight.

Furthermore, as the method of covering the cover, the same method as that of covering the above intermediate layer can be used, and a lot of recesses referred to as "dimples" are optionally formed on the surface. The golf ball of the present invention is generally put on the market after providing paint finishing, marking stamp, etc. to enhance the commercial value.

The multi-piece solid golf ball of the present invention is composed of a core, at least one intermediate layer and a cover and, by using as the core a void-containing molded article having a smaller specific gravity and using as the intermediate layer a high-specific gravity filler having a high specific gravity, the moment of inertia increases and the flight characteristics can be improved.

EXAMPLES

The following Examples further illustrate the present invention in detail but are not to be construed to limit the scope thereof.

Preparation of core

A core composition of the formulation shown in the following Table 1 was kneaded and then heat-pressed at 165° C. for 20 minutes to obtain a core having a diameter shown in the same table. Regarding Example 4, a core was obtained by injection molding. The specific gravity of the resulting core was measured and the results are shown in Table 1.

TABLE 1

Core formulation (Parts by weight)

| Kind | Example No. 1 | 2 | 3 | 4 | 5 | Comparative Example No. 1 | 2 |
|---|---|---|---|---|---|---|---|
| BR-18 (Note 1) | 100 | 100 | 100 | — | 100 | 100 | 100 |
| Zinc acrylate | 25 | 25 | 25 | — | 25 | 25 | 25 |
| Zinc oxide | 17 | 17 | 20 | — | 5 | 5 | 5 |
| Foaming agent (Note 2) | 7.5 | 7.5 | — | 55 | — | — | — |
| Foaming agent (Note 3) | 7.5 | 7.5 | — | — | — | — | — |
| Foaming agent (Note 4) | — | — | 7.5 | — | — | — | — |
| Microballoon (Note 5) | — | — | — | — | 70 | — | 70 |
| Antioxidant (Note 6) | 0.5 | 0.5 | 0.5 | — | 0.5 | 0.5 | 0.5 |
| Dicumyl peroxide | 2.0 | 2.0 | 2.0 | — | 2.0 | 2.0 | 2.0 |
| Ionomer resin (Note 7) | — | — | — | 100 | — | — | — |
| Specific gravity | 0.819 | 0.808 | 0.612 | 0.28 | 0.829 | 1.038 | 0.829 |
| Core diameter (mm) | 32 | 27 | 20 | 15 | 27 | 27 | 27 |

(Note 1): Polybutadiene rubber, manufactured by Nippon Synthetic Rubber Co., Ltd.
(Note 2): Trade name "Vinyhole AC#3", manufactured by Eiwa Kasei Kogyo Co., Ltd.
(Note 3): Trade name "Cellpaste 101", manufactured by Eiwa Kasei Kogyo Co., Ltd.
(Note 4): Trade name "Cellular GX", manufactured by Eiwa Kasei Kogyo Co., Ltd.
(Note 5): Trade name "Scotchlight Glassbubbles S60/10000", manufactured by Sumitomo 3M Co., Ltd.
(Note 6): Yoshinox 425, manufactured by Yoshitomi Seiyaku Co., Ltd.
(Note 7): Blend (50/50) of Hi-milan 1605/1706, manufactured by Mitsui Du Pont Polychemical Co., Ltd.

Preparation of intermediate layer (1)

Furthermore, an intermediate layer composition (1) of the formulation shown in Table 2 was prepared by mixing and was covered on the above core, followed by heat-pressing at 155° C. for 20 minutes to obtain a spherical material having a diameter shown in Table 2. The specific gravity of the resulting spherical material was measured and the results are shown in Table 2. In Examples 3 and 4, since the intermediate layer has a two-layer structure, an intermediate layer (2) is further covered on the intermediate layer (1).

TABLE 2

| Formulation for intermediate layer (1) | | | | | | | (Parts by weight) |
|---|---|---|---|---|---|---|---|
| | Example No. | | | | | Comparative Example No. | |
| Kind | 1 | 2 | 3 | 4 | 5 | 1 | 2 |
| BR-18 | 100 | 100 | 100 | 100 | 100 | 100 | 100 |
| Zinc acrylate | 30 | 30 | 30 | 30 | 30 | 30 | 30 |
| Zinc oxide | 5 | 5 | 5 | 5 | 5 | 42 | 63 |
| Tungsten C50H (Note 8) | 96 | 49 | 12 | 17 | 47 | — | — |
| Antioxidant | 0.5 | 0.5 | 0.5 | 0.5 | 0.5 | 0.5 | 0.5 |
| Dicumyl peroxide | 2.0 | 2.0 | 2.0 | 2.0 | 2.0 | 2.0 | 2.0 |
| Specific gravity | 1.717 | 1.397 | 1.136 | 1.176 | 1.385 | 1.271 | 1.385 |
| Diameter (mm) | 38.2 | 38.2 | 35.3 | 35.3 | 38.2 | 38.2 | 38.2 |

(Note 8): Tungsten, manufactured by Tokyo Tungsten Co., Ltd.

Preparation of intermediate layer (2)

Furthermore, an intermediate layer composition (2) of the formulation shown in Table 3 was prepared by mixing and was injection-molded on the above resulting core (1) in a thickness of 1.85 mm to obtain a spherical material having a diameter shown in Table 3. The specific gravity of the resulting spherical material was measured and the results are shown in Table 3.

TABLE 3

| Formulation for intermediate layer (2) | | | | | | | (Parts by weight) |
|---|---|---|---|---|---|---|---|
| | Example No. | | | | | Comparative Example No. | |
| Kind | 1 | 2 | 3 | 4 | 5 | 1 | 2 |
| Pandex T-7890 (Note 9) | — | — | 100 | 100 | — | — | — |
| Tungsten | — | — | 11.9 | 11.9 | — | — | — |
| Specific gravity | — | — | 1.25 | 1.25 | — | — | — |
| Diameter (mm) | — | — | 39.0 | 39.0 | — | — | — |

(Note 9): Polyurethane thermoplastic elastomer, manufactured by Dainippon Ink Chemical Industries Co., Ltd.

Dainippon Ink Chemical Industries Co., Ltd.

Examples 1 to 5 and Comparative Examples 1 to 2

A cover composition of the formulation shown in the following Table 4 was covered on the resulting intermediate layer by injection molding, and paint was applied on the surface to obtain a solid golf ball having a diameter of 42.7 mm. The flight performance of the resulting golf ball was evaluated and the results are shown in Table 5. The test method was as described below.

TABLE 4

| Formulation for cover | | | | | | | (Parts by weight) |
|---|---|---|---|---|---|---|---|
| | Example No. | | | | | Comparative Example No. | |
| Kind | 1 | 2 | 3 | 4 | 5 | 1 | 2 |
| Hi-milan 1605 | 50 | 50 | 50 | 50 | 50 | 50 | 50 |
| Hi-milan 1706 | 50 | 50 | 50 | 50 | 50 | 50 | 50 |
| Cover layer thickness (mm) | 2.25 | 2.25 | 1.85 | 1.85 | 2.25 | 2.25 | 2.25 |

(Test method)

(1) Flight distance

A driver (No.1 wood) was attached to a swing robot manufactured by True Temper Co. and a gold ball was hit at a head speed of 45 m/second. Then, a distance to the dropped point (carrier) was measured as a flight distance.

(2) Launch angle and launched spin amount

A photograph of the moment of an impact of a golf ball and a club head was taken by two cameras arranged at a fixed distance by staggering a fixed time, and the launch angle and launched spin amount were calculated from the distance.

(Test results)

TABLE 5

| | Example No. | | | | | Comparative Example No. | |
|---|---|---|---|---|---|---|---|
| Test item | 1 | 2 | 3 | 4 | 5 | 1 | 2 |
| Cover thickness (mm) | 2.25 | 2.25 | 1.85 | 1.85 | 2.25 | 2.25 | 2.25 |
| Launch angle (degree) | 11.62 | 11.51 | 11.97 | 11.82 | 11.45 | 11.00 | 11.40 |
| Spin amount (rpm) | 2730 | 2745 | 2685 | 2715 | 2770 | 2890 | 2780 |
| Flight distance (yard) | 229.7 | 230.0 | 232.4 | 231.3 | 229.5 | 226.2 | 227.5 |

As is apparent from the above results, the multi-piece solid golf ball of the present invention attains large flight distance compared with a solid golf ball according to the prior art.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A multi-piece solid golf ball comprising a core, an intermediate layer of one or more layers formed on the core and a cover formed on the intermediate layer, wherein the core is composed of a molded article containing voids and has a specific gravity of 0.2 to 0.9 and the intermediate layer contains a high-specific gravity filler and has a specific gravity of 1.1 to 1.8.

2. The multi-piece solid golf ball according to claim 1, wherein the high-specific gravity filler has a specific gravity of 8 to 20 and is selected from the group consisting of a metal powder, a metal oxide, metal nitride and mixture thereof.

3. The multi-piece solid golf ball according to claim 1 wherein the core is formed from a foamed vulcanized molded article of a rubber composition or a foamed molded article of a thermoplastic resin.

4. The multi-piece solid golf ball according to claim 1 wherein the core is formed from a vulcanized molded article of a rubber composition containing a light-weight filler with voids or a molded article of a thermoplastic resin containing a light-weight filler with voids.

* * * * *